US005107178A

United States Patent [19]

Ohyama et al.

[11] Patent Number: 5,107,178

[45] Date of Patent: Apr. 21, 1992

[54] METAL VAPOR DISCHARGE LAMP FILLED WITH BISMUTH, MERCURY, A RARE GAS, IRON AND A HALOGEN

[75] Inventors: Masachika Ohyama, Himeji; Tetsuo Fuse, Okayama; Akiyasu Yamaguchi, Himeji, all of Japan

[73] Assignee: Ushio Denki Kabushiki Kaisha, Japan

[21] Appl. No.: 636,587

[22] Filed: Jan. 2, 1991

[30] Foreign Application Priority Data

Jan. 16, 1990 [JP] Japan ..... 2-4461

[51] Int. Cl.[5] ..... H01J 17/20

[52] U.S. Cl. ..... 313/639; 313/638

[58] Field of Search ..... 313/639, 640, 641, 642, 313/637, 638, 490

[56] References Cited

U.S. PATENT DOCUMENTS

| | | | |
|---|---|---|---|
| 3,761,758 | 9/1973 | Bamberg et al. | 313/640 |
| 4,157,485 | 1/1979 | Wesselink et al. | 313/490 |
| 4,769,576 | 9/1988 | Ohyama et al. | 313/639 |

FOREIGN PATENT DOCUMENTS

| | | | |
|---|---|---|---|
| 83018743 | 7/1975 | Japan | 313/639 |
| 1161654 | 6/1989 | Japan | 313/639 |
| 1161655 | 6/1989 | Japan | 313/639 |
| 1161657 | 6/1989 | Japan | 313/639 |

*Primary Examiner*—Donald J. Yusko
*Assistant Examiner*—Partelis S. Halioris
*Attorney, Agent, or Firm*—Oliff & Berridge

[57] ABSTRACT

A metal vapor discharge lamp comprises a light-emitting tube filled with bismuth together with mercury, a rare gas, iron and a halogen in the range of 1/20–6/1 in terms of the gram atom ratio of bismuth to iron (Bi/Fe). A metal vapor discharge lamp also comprises a long light-emitting tube having an inner diameter D of 18–35 mm, equipped with a pair of electrodes and having an electrode interval L of 750 mm or greater, filled with bismuth together with mercury in a sealed amount of 0.6–2.0 mg per cc of the internal volume of the light-emitting tube, a rare gas, iron and a halogen in the range of 1/20–6/1 in terms of the gram atom ratio of bismuth to iron (Bi/Fe).

2 Claims, 2 Drawing Sheets

METAL VAPOR DISCHARGE LAMP FILLED WITH BISMUTH, MERCURY, A RARE GAS, IRON AND A HALOGEN

BACKGROUND OF THE INVENTION

1) Field of the Invention

This invention relates to a metal vapor discharge lamp suitable for use in the fields of photochemical reactions, curing of paints and inks, and the like.

2) Description of the Prior Art

Ultraviolet rays having a wavelength region of 280–400 nm are generally used in the fields of photochemical reactions, curing of paints and inks, and the like. In order to increase the radiant intensity of the ultraviolet rays of such a wavelength region, it is effective to fill a light-emitting tube with iron having a continuous spectrum in the wavelength region of 350–400 nm together with mercury.

However, in conventional metal vapor discharge lamps having light-emitting tubes in which iron is filled therein, iron deposits on the inner walls of their light-emitting tubes as the operation time goes on, thereby forming a thin film. Therefore, conventional metal vapor discharge lamps have the problem that the quantity of iron which contributes to the light emission becomes smaller and the through the light-emitting tubes, so that the radiant intensity of the ultraviolet rays s decreased to a great extent as time goes on.

In addition, when an electrode interval L is as long as 750 mm or greater in particular, namely, the light-emission length is longer, the following problem arises. Namely, even f such a discharge lamp is lighted in a horizontal direction, the intensity of the emission spectrum of iron becomes uneven along an axial direction of its light-emitting tube. The reason of this nonuniform phenomenon of the intensity is that iron filled within the light-emitting tube distributes unevenly therein and concentrates only in its central portion or one side. The occurrence of such an nonuniform phenomenon is accompanied by the disadvantages that a photochemical reaction from the transmitted light will undergo an uneven reaction, and irregular curing may occur upon the curing of paints or inks.

SUMMARY OF THE INVENTION

It is an object of this invention to provide a metal vapor discharge lamp having a light-emitting tube with iron filled therein, which is capable of preventing iron from depositing on the inner wall of its light-emitting tube.

Another object of this invention is to provide a metal vapor discharge lamp containing iron as a filled material and having a long light-emission length, which is capable of preventing iron from deposting on the inner wall of its light-emitting tube and also preventing the intensity of the emission spectrum of iron from becoming uneven.

With a view toward attaining the above first object, in the first aspect of this invention, there is thus provided a metal vapor discharge lamp comprising a light-emitting tube in which bismuth is filled together with mercury, a rare gas, iron and a halogen in the range of 1/20–6/1 in terms of the gram atom ratio of bismuth to iron (Bi/Fe).

With a view toward attaining the above second object, in the second aspect of this invention, there is also provided a metal vapor discharge lamp comprising a long light-emitting tube having an inner diameter D of 18–35 mm, equipped with a pair of electrodes and having an electrode interval L of 750 mm or greater, in which bismuth is filled together with mercury in a filled amount of 0.6–2.0 mg per cc of the internal volume of the light-emitting tube, a rare gas, iron and a halogen in the range of 1/20–6/1 in terms of the gram atom ratio of bismuth to iron (Bi/Fe).

According to this invention, since the filled amount of bismuth is defined within the range of 1/20–6/1 in terms of the gram atom ratio of bismuth to iron (Bi/Fe), the deposition of iron on the inner wall of the light-emitting tube can be effectively prevented without adversely affecting the intensity of the emission spectra of iron and mercury. Accordingly, ultraviolet rays having a wavelength region of 280–400 nm can be stably emitted over a long period of time while retaining the initial high radiant intensity. Any gram atom ratios of bismuth to ron (B/Fe) lower than 1/20 will result in a metal vapor discharge lamp incapable of effectively preventing iron from depositing on the inner wall of the light-emitting tube. On the other hand, any gram atom ratios Bi/Fe, higher than 6/1 will be accompanied by the disadvantage that the intensities of the emission spectra of mercury and iron become weaker, so that the intensity of the ultraviolet rays having effective wavelengths of 280–400 nm is decreased.

Alternatively, in the case where the electrode interval L is 750 mm or greater, namely, the light-emission length is longer, the filled amount of mercury is defined within the range of 0.6–2.0 mg per cc of the internal volume of the light-emitting tube in addition to the gram atom ratio of bismuth to iron (Bi/Fe). Therefore, the deposition of iron on the inner wall of the light-emitting tube can be sufficiently prevented without adversely affecting the intensity of the emission spectra of iron and mercury and moreover, the disadvantage that the intensity of the emission spectrum of iron becomes uneven along an axial direction of the light-emitting tube can be satisfactorily obviated. Accordingly, the evenness of the intensity of the emission spectrum of iron along the axial direction of the light-emitting tube can be enhanced. Any filled amounts of mercury less than 0.6 mg per cc of the internal volume of the light-emitting tube cannot obviate the problem that the intensity of the emission spectrum of iron becomes uneven along the axial direction of the tube. On the other hand, any filled amounts more than 2.0 mg/cc will result in a metal vapor discharge lamp in which the discharged arc is narrow. This is accompanied by the disadvantage that when this discharge lamp is lighted in a horizontal direction, the arc is raised, so that the light-emitting tube is locally devitrified at its upper portion.

The above and other objects, features and advantages of the present invention will become apparent from the following description and the appended claims, taken in conjunction with the accompanying drawings.

BRIEF DESCRIPTION OF THE DRAWINGS

In the accompanying drawings:

FIG. 2 diagrammatically illustrates characteristic curves indicating the changes of radiant intensity of ultraviolet rays having a wavelength region of 280–400 nm as the operation time goes on.

DETAILED DESCRIPTION OF THE INVENTION AND PREFERRED EMBODIMENTS

Example 1

The first embodiment of this invention will hereinafter be described specifically with reference to the drawings.

Figure 1:
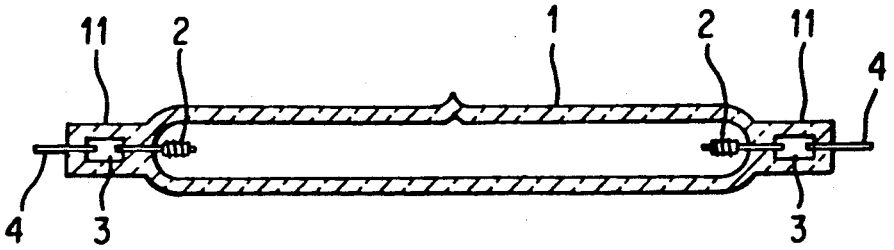
FIG. 1 is a schematic illustration of metal vapor discharge lamp having a light-emitting tube filled according to one embodiment of this invention.

This example is directed to a metal vapor discharge lamp whose rated power consumption is 4 KW. As illustrated in FIG. 1, a pair of electrodes 2, 2 are disposed in an opposing relation within a light-emitting tube 1 which comprises a quartz tube having an inner diameter of 22 mm. The electrode interval is 250 mm. Sealed portions 11 are provided at both ends of the light-emitting tube 1. Within each of the sealed portions 11, there is sealed a molybdenum foil 3 via which an outer lead 4 is electrically connected to its associated electrode 2.

Filled within the light-emitting tube 1 are 120 mg of metallic mercury, 12 mg of mercury iodide, 4 mg of iron, 5.3 mg of bismuth iodide and 20 mmHg of xenon gas. The filled amount of bismuth filled in the form of bismuth iodide is 1/8 in terms of the gram atom ratio of bismuth to iron.

Figure 2:
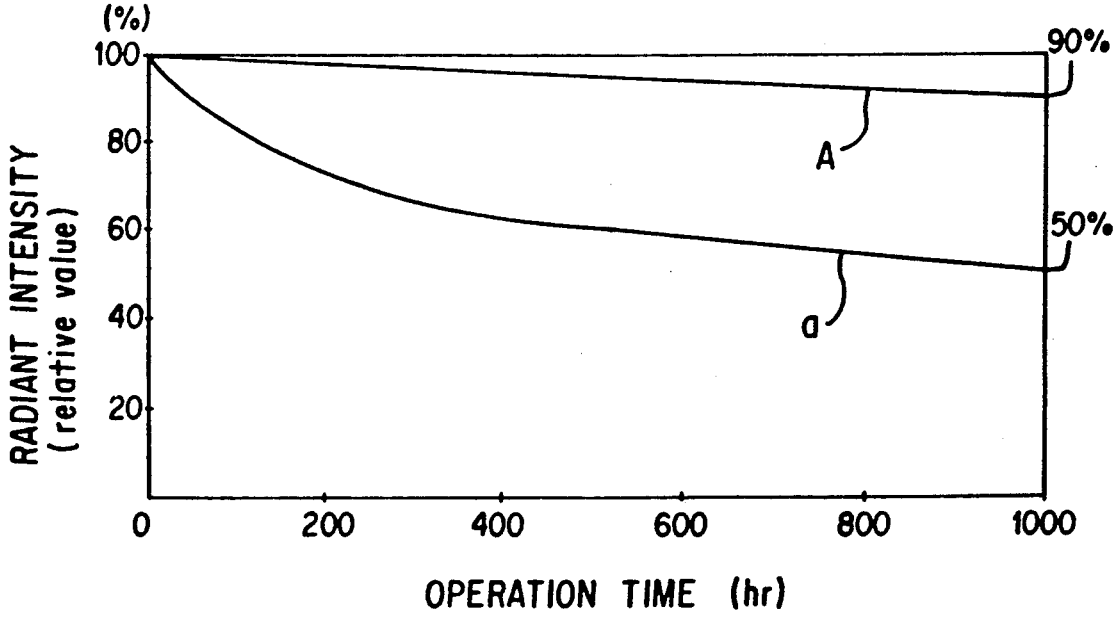

When this metal vapor discharge lamp was lighted, the lamp current and voltage were 12.2 A and 365 V, respectively, at a power consumption of 4 KW. The lamp was continuously lighted over 1,000 hours. No iron deposited on the inner wall of the light-emitting tube 1 and hence no thin film was formed. At the same time, variations of the output of ultraviolet rays having a wavelength region of 280–400 nm were determined. As a result, its output retention percent upon elapsed operation time of 1,000 hours was 90% as indicated by a characteristic curve A in FIG. 2.

For comparison, the same metal vapor discharge lamp as used in the above example except without the bismuth filling was lighted. As a result, it was found that iron began depositing on the inner wall of the light-emitting tube upon an elapsed time of about several tens of hours, thereby forming a thin film. Its output retention percent was reduced to 50% upon elapsed time of 1,000 hours as indicated by a characteristic curve a in FIG. 2.

Then, the influence of the filled amount of bismuth on the output of the ultraviolet rays was investigated. As shown in Table 1, when a gram atom ratio of bismuth to iron (Bi/Fe) fell within the range of 1/20–6/1, the output of ultraviolet rays was high at the beginning of operation, the deposition of iron on the inner wall of the light-emitting tube was prevented without adversely affecting the intensity of the emission spectra of iron and mercury, and the ultraviolet rays having a wavelength region of 280–400 nm were stably emitted even upon elapsed time of 1,000 hours while retaining the initial high radiant intensity. On the contrary, when the gram atom ratio Bi/Fe was lower than 1/20, the output of ultraviolet rays having a wavelength region of 280–400 nm was decreased to a great extent as the time went on. When the gram atom ratio Bi/Fe was higher than 6/1, the intensity of the emission spectra of mercury and iron was decreased and the initial output of ultraviolet rays having a wavelength region of 280–400 nm was somewhat reduced.

TABLE 1

The gram atom ratios of bismuth to iron and outputs (relative values) of ultraviolet rays at the beginning of operation as well as proportions (%) of the outputs of ultraviolet rays upon elapsed operation time of 1000 hours to those of the beginning and conditions of thin film deposition upon the elapsed time of 1000 hours

| Gram atom ratio of bismuth to iron (Bi/Fe) | Output of ultraviolet rays at the beginning of operation (relative value) | Proportion of output of ultraviolet rays upon elapsed operation time of 1000 hours to that of the beginning | Observation upon elapsed time of 1000 hours after the operation |
|---|---|---|---|
| 0 | 100 | 51% | A Fe film deposited to a great extent |
| 1/30 | 100 | 63% | A Fe film deposited to a medium extent |
| 1/20 | 100 | 70% | No Fe film deposited |
| 1/10 | 100 | 88% | " |
| 1/1 | 100 | 90% | " |
| 3/1 | 99 | 89% | " |
| 6/1 | 96 | 88% | " |
| 9/1 | 85 | 89% | " |

Example 2

The second embodiment of this invention will hereinafter be described.

This example is directed to a metal vapor discharge lamp larger in size than that used in Example 1. Its rated power consumption is 24 KW (lamp current: 11.8 A, lamp voltage: 2,260 V). With respect to other features thereof, as illustrated in FIG. 1, the inner diameter of light-emitting tube 1 is 22 mm, the electrode interval is 1,450 mm, and the materials used for filling are 800 mg of metallic mercury, 50 mg of mercury iodide (the filled amount of mercury per cc of the internal volume: 1.5 mg/cc), 8 mg of iron, 42 mg of bismuth iodide (Bi/Fe=1/2) and 20 mmHg of xenon gas.

When this metal vapor discharge lamp was lighted, no iron deposited on the inner wall of the light-emitting tube upon elapsed operation time of 1,000 hours similar to Example 1. The results of the radiant output of ultraviolet rays having a wavelength region of 280–400 nm were substantially the same as the characteristic curve A shown in FIG. 2, and were good.

Figure 3:
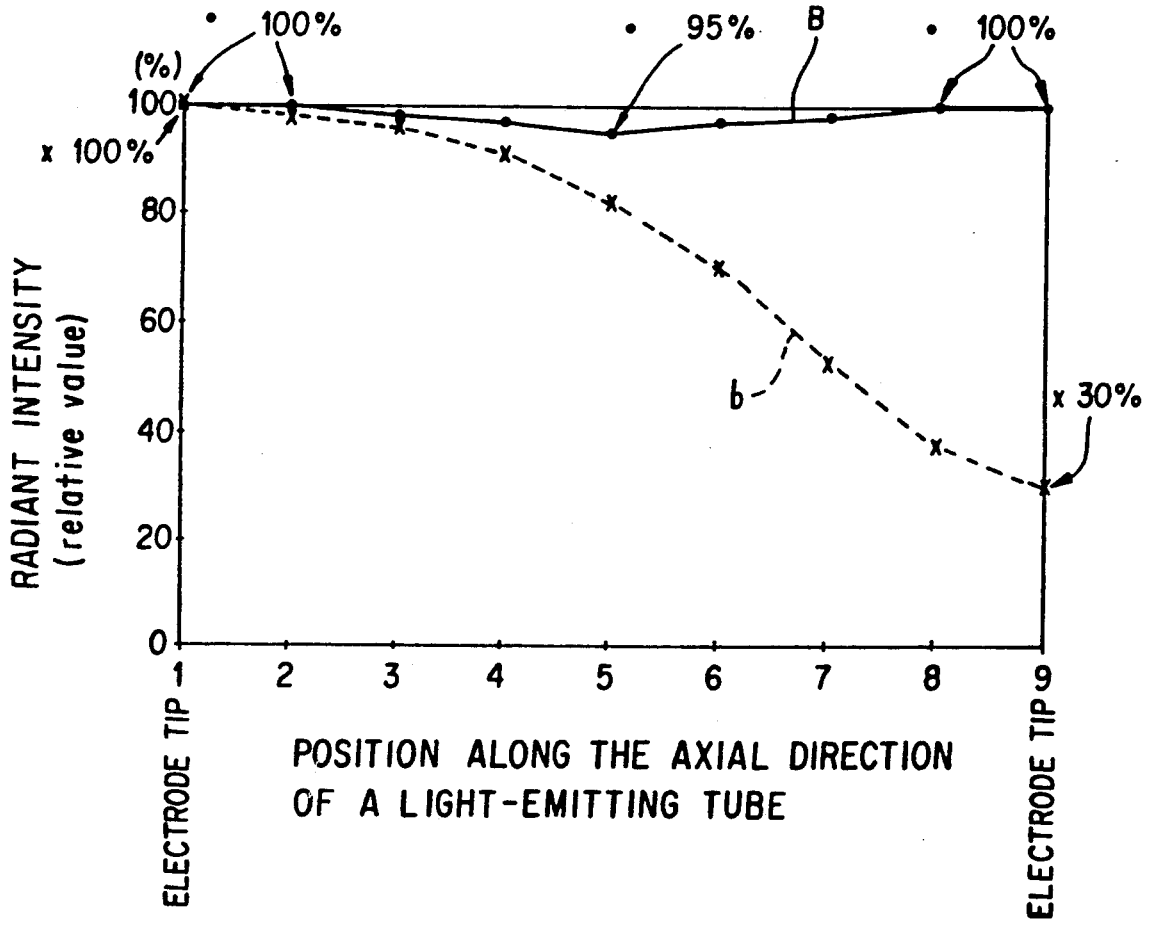
FIG. 3 diagrammatically illustrates characteristic curves indicating the intensity distribution of the emission spectrum of iron along an axial direction of a light-emitting tube.

The intensity distribution of the emission spectrum of iron along the axial direction of the light-emitting tube was determined. As a result, it was found that the radiant intensity along the axial direction of the light-emitting tube 1 was always even as indicated by a characteristic curve B in FIG. 3, and its evenness was not impaired at an operation frequency between 45 Hz and 65 Hz.

For comparison, the same metal vapor discharge lamp as used in the above example except that the filled amount of mercury was changed to 300 mg (about 0.5 mg/cc) was lighted to determine the intensity distribution of the emission spectrum of iron. As a result, it was found that the emission of iron was biased and the intensity distribution of its emission spectrum was decreased sharply toward the right side along the axial direction of the light-emitting tube 1. The portion of this bias of the emission of iron shifted as the time went on and also, when the operation frequency was changed.

Then, the influence of the filled amount of mercury on the intensity distribution of the emission spectrum of iron along the axial direction of the light-emitting tube was investigated. As shown in Table 2, when the filled amount of mercury fell within the range of 0.6–2.0 mg per cc of the internal volume of the light-emitting tube, no unevenness of the intensity of the emission spectrum of iron was recognized. However, when the filled amount of mercury was smaller than 0.6 mg/cc, the intensity of the emission spectrum of iron became significantly uneven along the axial direction of the light-emitting tube. On the other hand, when the filled amount of mercury exceeded 2.0 mg/cc, the discharged arc was narrow, and was raised in the vicinity of the electrodes or over the length, whereby the inner wall of the light-emitting tube was devitrified at portions where the arc struck on.

TABLE 2

| The filled amounts of mercury, and the intensity distribution of the spectrum of iron along the axial direction of the light-emitting tube and its observation results | | |
|---|---|---|
| Filled amount of mercury (mg/cc) | Intensity distribution of spectrum of iron (maximum value/minimum value) | Observation |
| 0.5 | 3.33 | The emission intensity of iron was biased all over at 45–65 Hz |
| 0.6 | 1.10 | The emission intensity of iron was even all over at 45–65 Hz |
| 1.0 | 1.06 | The emission intensity of iron was even all over at 45–65 Hz |
| 1.4 | 1.05 | The emission intensity of iron was even all over at 45–65 Hz |
| 1.8 | 1.04 | The emission intensity of iron was even all over at 45–65 Hz |
| 2.0 | 1.05 | The emission intensity of iron was even all over at 45–65 Hz |
| 2.2 | 1.05 | The arc was raised in its entirety |

Example 3

A metal vapor discharge lamp whose electrode interval was 1,450 mm and whose rated power consumption was 34.8 KW was fabricated by following the construction illustrated in FIG. 1 and filling a light-emitting tube having an inner diameter of 32 mm with the following materials.

| Filled materials: | |
|---|---|
| Metallic mercury: | 1,400 mg |
| Mercury iodide: | 55 mg |
| Iron: | 10 mg |
| Bismuth iodide: | 45 mg |
| Xenon gas: | 50 mg |

In this example, the filled amount of mercury per cc of the internal volume of the light-emitting tube is about 1.2 mg and the gram atom ratio of bismuth to iron is 1/2.35.

The thus-fabricated metal vapor discharge lamp was lighted continuously for 1,000 hours at a power consumption of 34.8 KW (lamp current: 11 A, lamp voltage: 3,515 V). As a result, the same results as those in Example 1 were attained. Namely, the metal vapor discharge lamp exhibited high radiant intensity of ultraviolet rays similar to that containing no bismuth. Besides, no deposition of iron on the inner wall of the light-emitting tube was recognized upon elapsed operation time of 1,000 hours and its output retention percent was 89%.

On the other hand, a comparative metal vapor discharge lamp having the same construction as that described above and containing no bismuth as a filled material was fabricated in the same manner as that described above except that bismuth iodide was omitted from the filled materials. It was then lighted n the same way as that described above. Radiant, intensity of ultraviolet rays similar to the value attained in this example was attained at the beginning of operation. However, iron began depositing on the inner wall of the light-emitting tube upon elapsed operation time of about several tens of hours and the formation of a thin film of iron was recognized. Change of the radiant intensity of the ultraviolet rays with time as to this comparative metal vapor discharge lamp was identical to the curve a in FIG. 2 and its output retention percent was about 50% upon elapsed operation time of 1,000 hours.

With respect to the same metal vapor discharge lamp as disclosed in this example, the intensity distribution of the emission spectrum of iron along the axial direction of the light-emitting tube was determined. As a result, it was confirmed that it exhibits high evenness over the whole length like the curve B in FIG. 3, and this evenness was not especially changed even when its operation frequency was varied between 45 Hz and 65 Hz.

On the other hand, a comparative metal vapor discharge lamp having the same construction as that described above was fabricated in the same manner as that described above except that the whole filled amount of mercury was changed to 590 mg (the filled amount of mercury per cc of the internal volume of the light-emitting tube: about 0.5 mg/cc). It was then lighted under the same conditions as those described above to determine the intensity distribution of the emission spectrum of iron. As a result, it was found that the emission spectrum of iron was emitted strongly only at one end side and was greatly decreased at the other end side like the curve b in FIG. 3. This appearance of the unevenness varied as the time went on and also, when the operation frequency was changed.

Then, the influence of the filled amount of mercury on the intensity distribution of the emission spectrum of iron along the axial direction of the light-emitting tube was investigated. The results were the same as those shown in Table 2. When the filled amount of mercury fell within the range of 0.6–2.0 mg per cc of the internal volume of the light-emitting tube, even intensity of the emission spectrum of iron was attained.

By the way, bismuth used in this invention may be in the form of metallic bismuth, and argon, krypton, neon and the like other than xenon may be used either singly or in combination as a rare gas for filing.

Having now fully described the invention, it will be apparent to one of skill in the art that many changes and modifications can be made thereto without departing from the spirit or scope of the invention as set forth herein.

What is claimed is:

1. A metal vapor discharge lamp comprising a light-emitting tube filled with bismuth together with mercury, a rare gas, iron and a halogen in the range of 1/20–6/1 in terms of the gram atom ratio of bismuth to iron (Bi/Fe).

2. A metal vapor discharge lamp comprising a long light-emitting tube having an inner diameter D of 18–35 mm, equipped with a pair of electrodes and having an electrode interval L of 750 mm or greater, filled with bismuth together with mercury in a filled amount of 0.6–2.0 mg per cc of the internal volume of the light-emitting tube, a rare gas, iron and a halogen in the range of 1/20–6/1 in terms of the gram atom ratio of bismuth to iron (Bi/Fe).

* * * * *